US006085384A

United States Patent [19]

Bivens

[11] Patent Number: 6,085,384

[45] Date of Patent: Jul. 11, 2000

[54] ONE-WAY HINGE DAMPER

[75] Inventor: Steven L. Bivens, Kankakee, Ill.

[73] Assignee: Illinois Tool Works Inc., Glenview, Ill.

[21] Appl. No.: 09/286,944

[22] Filed: Apr. 8, 1999

[51] Int. Cl.[7] ..... E05F 3/20

[52] U.S. Cl. ..... 16/54; 16/82; 16/50

[58] Field of Search ..... 16/54, 51, 52, 16/50, 82, 84, 85, 342, DIG. 9; 188/290, 291, 306, 276

[56] References Cited

U.S. PATENT DOCUMENTS

| | | | |
|---|---|---|---|
| 3,118,167 | 1/1964 | Morris et al. . | |
| 3,401,422 | 9/1968 | Ventura | 16/54 |
| 3,952,365 | 4/1976 | Grisebach | 16/82 |
| 4,004,667 | 1/1977 | Vaitys . | |
| 4,069,545 | 1/1978 | Holet et al. . | |
| 4,411,341 | 10/1983 | Schultz | 16/57 |
| 4,513,473 | 4/1985 | Omata . | |
| 4,574,423 | 3/1986 | Ito et al. . | |
| 4,618,039 | 10/1986 | Omata | 188/268 |
| 4,638,528 | 1/1987 | Omata | 16/82 |
| 4,697,673 | 10/1987 | Omata . | |
| 4,908,905 | 3/1990 | Kanno et al. . | |
| 5,064,033 | 11/1991 | Koike et al. . | |
| 5,165,507 | 11/1992 | Ohshima | 16/82 |
| 5,335,563 | 8/1994 | Yamamoto et al. . | |
| 5,432,582 | 7/1995 | Horning et al. . | |

FOREIGN PATENT DOCUMENTS 63-231029 9/1988 Japan .

*Primary Examiner*—Chuck Y. Mah

*Attorney, Agent, or Firm*—Pitney, Hardin, Kipp and Szuch LLP

[57] ABSTRACT

The one-way hinge damper includes a cylindrical housing into a rotor is rotatably inserted. A gap is formed between the rotor and the cylindrical housing which is filled with silicone or a similar viscous fluid for damping the rotation of the rotor. The damping can be increased by forming longitudinal grooves or similar discontinuities in the interior surface of the cylindrical housing and longitudinal passageways on the exterior surface of the rotor. A clutch, to which the output shaft is attached, is biased against an end of the rotor by a wave spring. Both the clutch and the end of the rotor include complementary rotationally alternating ramped surfaces and flat (or longitudinally level) surfaces. Radially extending walls are formed between the higher end of the ramped surfaces and the adjacent flat surface. When the output shaft and the clutch are rotated in a first direction, the radially extending walls of the clutch align with and engage the radially extending walls of the rotor and the rotor rotates through the viscous fluid thereby achieving damping. However, when the output shaft and clutch are rotated in a second direction, the ramped surfaces of the clutch "ramp over" the ramped surfaces of the rotor, and the rotor does not rotate, thereby allowing the clutch and output shaft to rotate substantially free of damping.

12 Claims, 2 Drawing Sheets

ONE-WAY HINGE DAMPER

BACKGROUND OF THE INVENTION

1. Field of the Invention

This invention pertains to a hinge damper with damping in one direction of rotation. The damper includes a gel-filled housing in which a rotor rotates, and a clutch which is affixed to the output shaft. The rotor and the clutch abut each other and have a series of alternating flat surfaces and ramped surfaces to provide for engagement and subsequent damping in one direction of rotation of the clutch, and disengagement or ramping over with no damping in the other direction of rotation of the clutch.

2. Description of the Prior Art

In the prior art, rotary dampers or hinge dampers are known. However, two-way damping can be undesirable in such applications as an automotive glovebox as unwanted resistance is encountered when closing the door of the glovebox. One-way rotational dampers as those disclosed in U.S. Pat. No. 4,574,423 entitled "Rotary Damper Having a Clutch Spring and Viscous Fluid" issued to Ito et al. on Mar. 11, 1986 have relied on a coil spring for the one-way rotational damping characteristics. This has not been satisfactory in that the manufacturing costs have been high and the device has not been mechanically satisfactory. Additionally, with the small amount of viscous fluid included in this device, a smooth feel, such as is desired in an automotive application, such as a glovebox, has not been satisfactorily achieved.

OBJECTS AND SUMMARY OF THE INVENTION

It is therefore an object of this invention to provide a hinge damper with unidirectional rotational damping.

It is therefore a further object of this invention to provide a hinge damper with a smooth feel.

It is therefore a still further object of this invention to provide a hinge damper with reliable mechanical characteristics.

It is therefore a final object of this invention to provide a hinge damper with low manufacturing costs.

These and other objects are attained by providing a hinge damper with a housing filled with silicone in which a rotor rotates. The output shaft is affixed to a clutch. The rotor and the clutch abut each other and both include a series of molded flat surfaces and ramped surfaces to provide for rotational engagement and subsequent damping in one direction of rotation. However, in the opposite direction of rotation of the clutch and output shaft, the ramped surfaces on the clutch and rotor ramp over each other and the rotor does not turn. The clutch is urged against the rotor by a wave spring which is held in place by a cap.

The housing, rotor, clutch and cap can be made from molded plastic which reduces manufacturing expenses.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
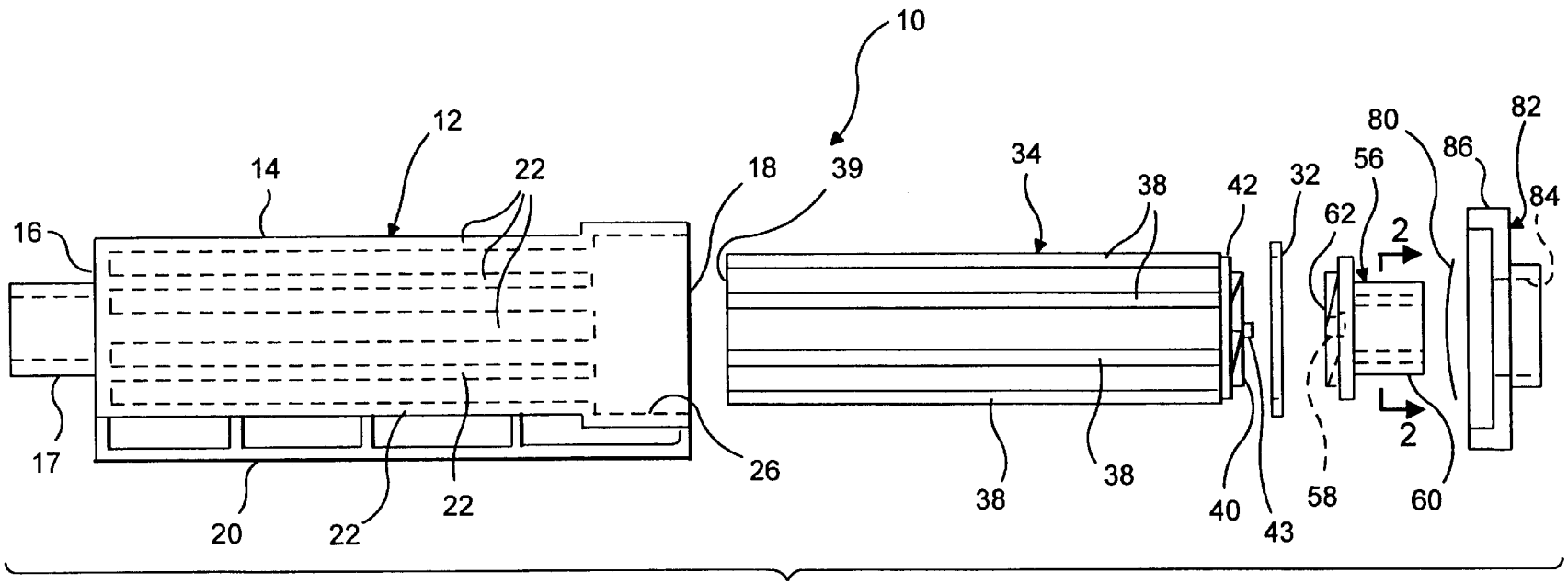
FIG. 1 is an exploded view, partly in phantom, of the hinge damper of the present invention.

Referring now to the drawings in detail wherein like numerals refer to like elements throughout the several views, one sees that FIG. 1 is an exploded view of one-way hinge damper 10 of the present invention.

Figure 6:
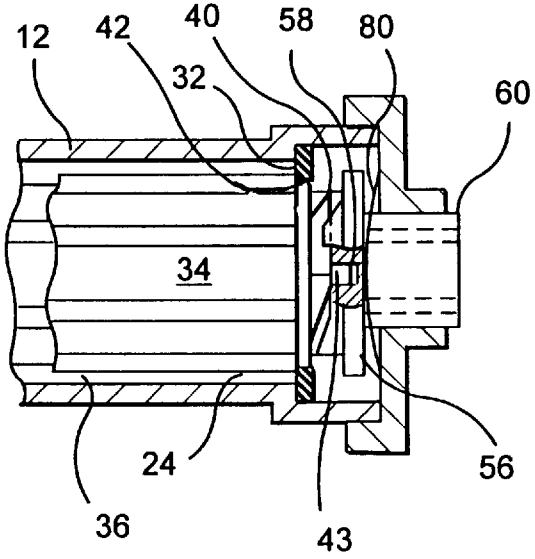
FIG. 6 is a cross-sectional plan view showing the engagement of the rotor to the clutch.

Housing 12 is generally cylindrical and is formed from cylindrical wall 14, closed end 16 and open end 18. Closed end 16 is affixed to cylindrical detent stub 17 which is affixed to one of the structures (not shown) for which rotational damping is desired, such as the instrument panel of an automobile (not shown), to which the glovebox door (not shown) is rotationally damped. Similarly, longitudinally oriented support 20 is affixed to cylindrical wall 14 to aid in the handling or securing of housing 12. The interior of cylindrical wall 14 can be smooth, but can optionally include longitudinal grooves 22 in order to increase the damping function of silicone 24 or other similar viscous damping fluid or gel which fills housing 12 (see FIG. 6).

Figure 4:
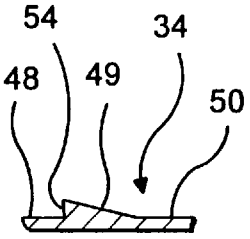
FIG. 4 is a cross-sectional view along plane 4—4 of FIG. 3.
Figure 3:
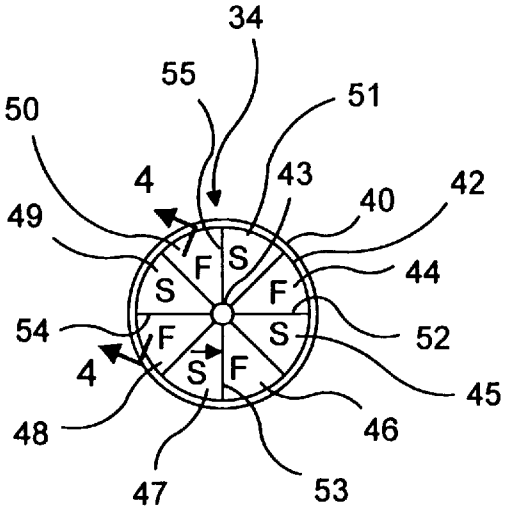
FIG. 3 is a front plan view of the clutch of the present invention.

Open end 18 includes widened mouth 26. Cylindrical rotor 34 is received with cylindrical wall 14 of housing 12 with a small gap 36 therebetween (see FIG. 6) which is filled with silicone 24. The exterior of cylindrical rotor 34 is preferably smooth, but can optionally include longitudinal passageways 38 leading to the hollow interior of cylindrical rotor 34 to increase the damping function of silicone 24. The forward end 40 of cylindrical rotor 34 includes portion 42 of slightly reduced diameter in order to be engaged by seal 32. As shown in FIGS. 3 and 4, forward end 40 of cylindrical rotor 34 further includes central pin 43 about which flat or longitudinally level sections 44, 46, 48, 50 rotationally alternate with ramped (or sloped) sections 45, 47, 49, 51. In the configuration shown in FIG. 3, ramped sections 45, 47, 49, 51 ramp upwardly in the counter-clockwise direction. Hence, radially extending walls 52, 53, 54, 55 are formed at the intersection of flat and sloped sections 44, 45, sections 46, 47, sections 48, 49, and sections 50, 51, respectively.

Figure 2:
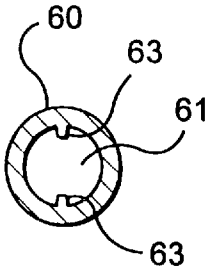
FIG. 2 is a cross-sectional view along plane 2—2 of FIG. 1.
Figure 5:
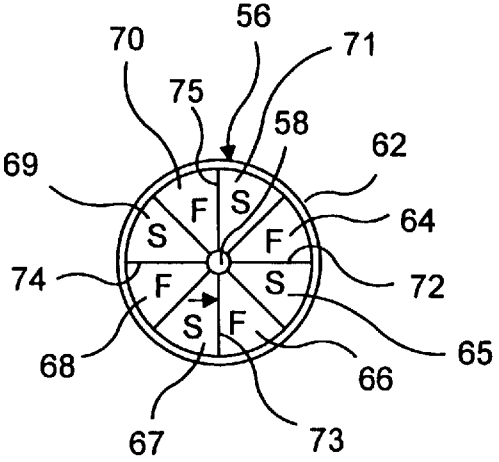
FIG. 5 is a front plan view of the cylindrical rotor of the present invention.

Clutch 56 includes central aperture 58 which receives central pin 43 of cylindrical rotor 34 to maintain radial alignment of clutch 56-and cylindrical rotor 34. Similarly, while not shown, rear end 39 of cylindrical rotor 34 can include structure to rotationally engage an interior surface of closed end 16 of housing 12 to maintain radial alignment of cylindrical rotor 34. Clutch 56 is integral with output shaft 60, which is typically affixed to a structure (not shown) for which rotational damping is desired, such as the door of an automotive glovebox (not shown). As shown in FIG. 2, output shaft 60 may have interior aperture 61 with inwardly facing detents 63, although other configurations may be used depending upon the application as would be apparent to those skilled in the art. Face 62 of clutch 56 engages against forward end 40 of cylindrical rotor 34 and, as shown in FIG. 5, includes a similar configuration of flat or longitudinally level sections 64, 66, 68, 70 rotationally alternating with ramped sections 65, 67, 69, 71, and radially extending walls 72, 73, 74, 75 formed between the portions of ramped sections 65, 67, 69, 71 and rotationally adjacent flat sections 64, 66, 68, 70. With this configuration, when viewed from the perspective of output shaft 60 (from the right toward the left in the orientation shown in FIG. 1), when output shaft 60 is turned clockwise, radially extending walls 52, 53, 54, 55 of forward end 40 of cylindrical rotor 34 align with corresponding radially extending walls 72, 73, 74, 75 of face 62 of clutch 56 and cylindrical rotor 34 is rotated through silicone 24 or other similar viscous damping fluid or gel thereby providing damping. However, when output shaft 60 is turned counter-clockwise, ramped sections 45, 47, 49, 51 of forward end 40 of cylindrical rotor 34 "ramp over" or slide over corresponding ramped sections 65, 67, 69, 71 of face 62 of clutch 56 thereby not rotating cylindrical rotor 34 and resulting in essentially no damping of clutch 56 and output shaft 60. A typical application for such a configuration is to have damping as a glovebox door (not shown) is opened, but no damping as the glovebox door is closed.

The positioning of where clutch 56 engages cylindrical rotor 34 can be determined by dividing a circle by the number of ramped sections used. For instance, for engagement every ninety degrees, four ramped sections are used as disclosed herein.

Wave spring 80 includes central aperture (not shown) through which output shaft 60 passes so that wave spring 80 abuts clutch 56. Wave spring 80 has a washer-type shape but includes circumferential undulations or waves to provide a spring function in the longitudinal direction.

Cap 82 includes central aperture 84 through which output shaft passes 60 and circumferential flange 86 which is secured to the outer periphery of open end 18 of housing 12. Additionally, cap 82 secures wave spring 80 in a biased position against clutch 56 thereby biasing clutch 56 against forward end 40 of cylindrical rotor 34.

Typically, housing 12, cylindrical rotor 34, clutch 56 and cap 82 are formed of molded plastic. Seal 32 is typically rubber and wave spring 80 is typically metallic.

To assemble one-way hinge damper 10, the assembler partially fills housing 12 with silicone 24 or other similar viscous damping fluid or gel. The assembler then inserts cylindrical rotor 34 into housing 12 and inserts seal 32 onto portion 42 of slightly reduced diameter of cylindrical rotor 34. Clutch 56 is placed over forward end 40 of cylindrical rotor 34 so that ramped sections 65, 67, 69, 71 of clutch 56 align with ramped sections 45, 47, 49, 51 of cylindrical rotor 34. Wave spring 80 is placed around output shaft 60 and cap 82 is snapped or welded into place.

To install one-way hinge damper 10, cylindrical detent stub 17 is affixed to a first structural element and output shaft 60 is attached to a second structural element so that the desired directional damping characteristics are achieved.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A hinge damper comprising:

a housing formed of a cylindrical wall, a rotor rotatably within said cylindrical wall, a gap being formed between said cylindrical wall and said rotor, said rotor further including first complementary surfaces on an end of said rotor;

viscous fluid within said gap;

a clutch rotatably within said cylindrical wall and including second complementary surfaces on an end of said clutch;

means for biasing said end of said rotor against said end of said clutch, wherein in a first direction of rotation of said clutch, said first complementary surfaces engage said second complementary surfaces thereby rotating said rotor in response to rotation of said clutch and wherein in a second direction of rotation of said clutch, said first complementary surfaces disengage from said second complementary surfaces whereby said clutch rotates substantially free of engagement with said rotor.

2. The hinge damper of claim 1 further including an output shaft which is integral with and turns in unison with said clutch.

3. The hinge damper of claim 2 further including a spring for biasing said end of said rotor against said end of said clutch.

4. The hinge damper of claim 3 wherein said first complementary surfaces and said second complementary surfaces comprise ramped surfaces which terminate on one side thereof in radially extending walls, and wherein said radially extending walls of said first complementary surfaces engage radially extending walls of said second complementary surfaces in said first direction of rotation.

5. The hinge damper of claim 4 wherein in said second direction of rotation, said radially extending walls of said ramped surfaces of said first complementary surfaces slide over said ramped surfaces of said second complementary surfaces.

6. The hinge damper of claim 5 wherein said ramped surfaces of said first complementary surfaces and said second complementary surfaces rotationally alternate with longitudinally level surfaces.

7. The hinge damper of claim 6 wherein uneven surfaces are formed on an interior of said cylindrical walls and on an exterior of said rotor.

8. The hinge damper of claim 7 wherein said uneven surfaces are longitudinal grooves on said interior of said cylindrical walls and longitudinal passageways on said exterior of said rotor.

9. The hinge damper of claim 8 wherein said spring is a wave spring.

10. The hinge damper of claim 9 wherein said output shaft passes through said wave spring.

11. The hinge damper of claim 10 wherein a cap is formed on an end of said housing, said output shaft passing through said cap, and said cap urging said wave spring against said clutch.

12. The hinge damper of claim 11 wherein said viscous damping fluid is silicone.

* * * * *